US006561615B2

(12) United States Patent
Okawa et al.

(10) Patent No.: US 6,561,615 B2
(45) Date of Patent: May 13, 2003

(54) IMAGE FORMING APPARATUS

(75) Inventors: Kenichi Okawa, Akiruno (JP); Keiji Izumi, Hino (JP)

(73) Assignee: Olympus Optical Co., Ltd., Tokyo (JP)

( * ) Notice: Subject to any disclaimer, the term of this patent is extended or adjusted under 35 U.S.C. 154(b) by 0 days.

(21) Appl. No.: 10/092,797

(22) Filed: Mar. 7, 2002

(65) Prior Publication Data

US 2002/0130922 A1 Sep. 19, 2002

(30) Foreign Application Priority Data

Mar. 13, 2001 (JP) ..... 2001-071029
Mar. 14, 2001 (JP) ..... 2001-072159

(51) Int. Cl.[7] ..... B41J 29/393
(52) U.S. Cl. ..... 347/19
(58) Field of Search ..... 347/19; 400/74

(56) References Cited

U.S. PATENT DOCUMENTS 5,250,956 A * 10/1993 Haselby et al. ..... 347/19
6,419,342 B1 * 7/2002 Bronswijk et al. ..... 347/19

FOREIGN PATENT DOCUMENTS

JP 05-278306 A 10/1993
JP 2001-113679 A 4/2001

* cited by examiner

*Primary Examiner*—John Barlow
*Assistant Examiner*—Julian D. Huffman
(74) *Attorney, Agent, or Firm*—Frishauf, Holtz, Goodman & Chick, P.C.

(57) ABSTRACT

An image forming apparatus carries out image formation by main scanning and sub-scanning a plurality of print heads relatively with respect to a printing medium. The plurality of print heads form a plurality of test pattern images on the printing medium by one main scanning by a main scanning mechanism. A scanner reads the plurality of test pattern images by sub-scanning by the sub-scanning mechanism, without moving in the main scanning direction. On the basis of results of detection from the scanner, a control section calculates an amount of positional offset, in a sub-scanning direction, of two print heads which form the test pattern images.

17 Claims, 11 Drawing Sheets

| Nozzle No. | | Count value |
|---|---|---|
| (1) | 1 | 78 |
| (2) | 5 | 62 |
| (3) | 9 | 46 |
| (4) | 13 | 30 |
| (5) | 17 | 14 |
| Mean value | | 46 |

| Nozzle No. | | Count value |
|---|---|---|
| (1) | 493 | 84 |
| (2) | 497 | 68 |
| (3) | 501 | 52 |
| (4) | 505 | 36 |
| (5) | 509 | 20 |
| Mean value | | 52 |

| Measured color | K | C | M | LC | LM | Y |
|---|---|---|---|---|---|---|
| Used channel | G | R | G | R | G | B |

| Measured color | K-C | C-M | M-LC | LC-LM | LM-Y |
|---|---|---|---|---|---|
| Used channel | R | G | G | G | B |

| | Nozzle No. | Count value |
|---|---|---|
| (1) | 1 | 78+2=80 |
| (2) | 5 | 62+2=74 |
| (3) | 9 | 46+2=48 |
| (4) | 13 | 30+2=32 |
| (5) | 17 | 14+2=16 |
| | Mean value | 48 |
FIG. 13
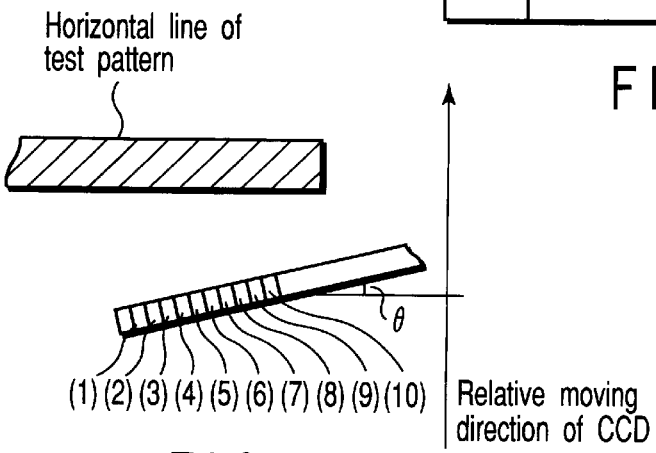
FIG. 14
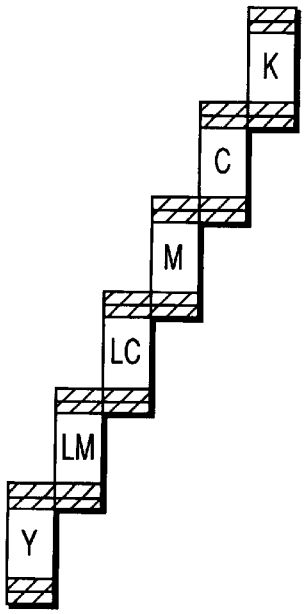
FIG. 15A
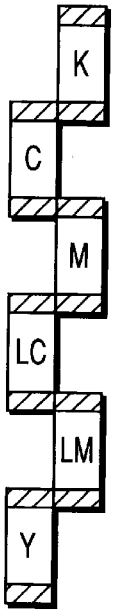
FIG. 15B

IMAGE FORMING APPARATUS

CROSS-REFERENCE TO RELATED APPLICATIONS

This application is based upon and claims the benefit of priority from the prior Japanese Patent Applications No. 2001-071029, filed Mar. 13, 2001; and No. 2001-072159, filed Mar. 14, 2001, the entire contents of both of which are incorporated herein by reference.

BACKGROUND OF THE INVENTION

1. Field of the Invention

The present invention relates to an image forming apparatus, and in particular, to an image forming apparatus in which, when printing is carried out by a plurality of print heads, a sensor reads at least two test patterns by sub-scanning one time, and a control section carries out alignment of the respective print heads on the basis of the results.

2. Description of the Related Art

Conventionally, in an ink jet printer which is a type which prints by ejecting ink from a print head having a plurality of nozzles, a so-called "serial system", which forms an image by making the print head move reciprocally along a main scanning direction (a direction perpendicular to the conveying direction of a print medium) while the print medium is conveyed intermittently (step feeding), is the mainstream system. In this "serial system", the width (the printing width of one scan of the print head) of a line of nozzles provided along the sub-scanning direction of the print head (a direction parallel to the conveying direction of the print medium) greatly affects the printing time. Accordingly, the larger the number of nozzles a print head has, i.e., the longer the head is, the shorter the printing time becomes.

However, manufacturing the long head has many problems from the standpoints of the precision of arranging the nozzles, the ink ejecting performance, high costs, and the like.

With respect to this point, by connecting a plurality of so-called short heads, which have a relatively small number of nozzles, in the sub-scanning direction, the short heads can be considered as a long head. High speed printing can be carried out in the same way as the case of using one long head.

The above describes a case of monochrome, and in the case of color, when a serial system is adopted, in order to avoid color mixing of the inks, in-line arrangement of various types (the types of ink are different) of print heads is not carried out, and the print heads are arranged so as to be offset in the sub-scanning direction (hereinafter, this will be called prior art 1).

Here, in Jpn. Pat. Appln. KOKAI Publication No. 05-278306, there is disclosed a technique of mounting a optical sensor to a carriage on which a plurality of printing elements are mounted, and detecting, by this optical sensor, a horizontal position of a vertical segment printed parallel to a medium scanning axis, and a vertical position of a horizontal segment printed parallel to a carriage scanning axis, and carrying out position adjustment of the cartridge on the basis thereof. (Hereinafter, this will be called prior art 2.).

However, in the above-described conventional technique 1, in both cases of monochrome and color, the intervals between the respective print heads disposed along the sub-scanning direction must be disposed such that the nozzle pitches of the print heads are equal intervals between the print heads as well. Namely, in the case of monochrome, if the nozzle pitch at the joint between print heads is large, so-called "white streaks" become conspicuous, and if small, so-called "black streaks" become conspicuous.

Further, in the case of color, i.e., when one pixel is formed by dots of plural colors, it is expressed as a change in color tint and the color reproduceability and uniformity deteriorate.

In this way, if the positions, in the sub-scanning direction, between the respective print heads are not disposed accurately, it leads to a deterioration in the quality of the printed image, which is problematic.

On the other hand, in above-described conventional technique 2, because one test pattern is read by one scan operation, plural scan operations are needed in order to read plural test patterns. Accordingly, because advancing/retracting of the print medium conveying is repeated, the effects of errors in conveying the print medium become large, and errors in detecting the print head position as well occur easily.

BRIEF SUMMARY OF THE INVENTION

Accordingly, an object of the present invention is to provide an image forming apparatus in which positional offset, in the sub-scanning direction, between plural print heads can be easily detected, and the positional offset can be accurately adjusted while reducing the effects of errors in print medium conveying.

In order to achieve the above-described object, according to a first aspect of the present invention, there is provided an image forming apparatus comprising: a plurality of heads; a scanner reading an image printed by the plurality of print heads; a main scanning mechanism which causes the plurality of print heads and the scanner to perform main scanning relative to a printing medium; a sub-scanning mechanism which causes the plurality of print heads and the scanner to perform sub-scanning relative to the printing medium; and a control section calculating an amount of positional offset of each print head in accordance with a position of the image read by the scanner, the image forming apparatus carrying out image formation by relatively main scanning and sub-scanning the plurality of print heads with respect to the printing medium, wherein (a) the plurality of print heads form a plurality of test pattern images on the printing medium in one main scanning by the main scanning mechanism;

(b) the scanner reads the plurality of test pattern images by sub-scanning by the sub-scanning mechanism, without moving in the main scanning direction; and (c) on the basis of results of detection from the scanner, the control section computes an amount of positional offset, in a sub-scanning direction, at the two print heads which form the test pattern images.

Further, according to a second aspect of the present invention, there is provided an image forming apparatus according to the first aspect, wherein the plurality of print heads and the scanner are fixed on a carriage which is movable in the main scanning direction by the main scanning mechanism.

Further, according to a third aspect the present invention, there is provided an image forming apparatus according to the first aspect, wherein the plurality of test patterns are printed by two print heads adjacently fixed on a carriage.

Further, according to a fourth aspect of the present invention, there is provided an image forming apparatus according to the second aspect, wherein the plurality of test patterns have horizontal lines at end portions at sides near each other.

Further, according to a fifth aspect of the present invention, there is provided an image forming apparatus according to the fourth aspect, wherein the plurality of test patterns have the plurality of horizontal lines.

Further, according to a sixth aspect of the present invention, there is provided an image forming apparatus according to the fourth aspect, wherein the plurality of test patterns each have the same number of a plurality of horizontal lines.

Further, according to a seventh aspect of the present invention, there is provided an image forming apparatus according to the sixth aspect, wherein intervals, in the sub-scanning direction, between the plurality of horizontal lines of each test pattern are constant.

Further, according to an eighth aspect of the present invention, there is provided an image forming apparatus according to the sixth aspect, wherein the plurality of test patterns are printed so as to not overlap each other.

Further, according to a ninth aspect of the present invention, there is provided an image forming apparatus according to the eighth aspect, wherein the plurality of test patterns are printed at different positions in the main scanning direction.

Further, according to a tenth aspect of the present invention, there is provided an image forming apparatus according to the ninth aspect, wherein the plurality of test patterns are printed such that the horizontal lines are contained within a range of a reading width of the scanner.

Further, according to an eleventh aspect of the present invention, there is provided an image forming apparatus according to the eighth aspect, wherein the plurality of test patterns are printed at the same position in the main scanning direction.

Further, according to a twelfth aspect of the present invention, there is provided an image forming apparatus according to the second aspect, wherein the sub-scanning mechanism has a conveying roller conveying the printing medium in the sub-scanning direction; a conveying motor applying driving force to the conveying roller; and a conveying motor control section applying a driving pulse to the conveying motor; and the control section calculates positional offset, in the sub-scanning direction, of two print heads on the basis of the results of detection of the scanner and a number of pulses of the conveying motor control section.

Further, according to a thirteenth aspect of the present invention, there is provided an image forming apparatus according to the twelfth aspect, wherein, while the scanner reads the plurality of test patterns, the conveying motor control section applies predetermined pulses to the conveying motor and intermittently conveys the printing medium in the sub-scanning direction.

Further, according to a fourteenth aspect of the present invention, there is provided an image forming apparatus according to the thirteenth aspect, wherein, when the scanner reads the plurality of test patterns, the conveying motor control section conveys the printing medium in the same direction as a printing medium conveying direction at a time of image printing.

Further, according to a fifteenth aspect of the present invention, there is provided an image forming apparatus according to the twelfth aspect, wherein, while the scanner reads the plurality of test patterns, the main scanning mechanism stops movement of the carriage.

Further, according to a sixteenth aspect of the present invention, there is provided an image forming apparatus according to the first aspect, wherein the scanner has a sensor to which three color filters of R, G, B are applied.

Further, according to a seventeenth aspect of the present invention, there is provided an image forming apparatus according to the sixteenth aspect, wherein, when two test pattern images having different colors are read among the plurality of test patterns, the scanner uses a sensor to which a color filter, which is such that a sensitivity of the test pattern image having a lowest sensitivity is made to be a highest sensitivity, is applied.

Additional objects and advantages of the invention will be set forth in the description which follows, and in part will be obvious from the description, or may be learned by practice of the invention. The objects and advantages of the invention may be realized and obtained by means of the instrumentalities and combinations particularly pointed out hereinafter.

BRIEF DESCRIPTION OF THE SEVERAL VIEWS OF THE DRAWING

FIG. 13 is a table showing results of inclination correction on count values detected in the region b.

FIG. 14 is a diagram showing a slope θ with respect to an arrangement direction of the CCD 37.

FIG. 15A is a diagram showing an arrangement of test patterns of six colors in accordance with the first embodiment.

FIG. 15B is a diagram showing an arrangement of test patterns of six colors in accordance with a second embodiment of the present invention.

The accompanying drawings, which are incorporated in and constitute a part of the specification, illustrate presently preferred embodiment of the invention, and together with the general description given above and the detailed description of the preferred embodiment given below, serve to explain the principles of the invention.

DETAILED DESCRIPTION OF THE INVENTION

Hereinafter, embodiments of the present invention will be described with reference to the drawings.

Figure 1:
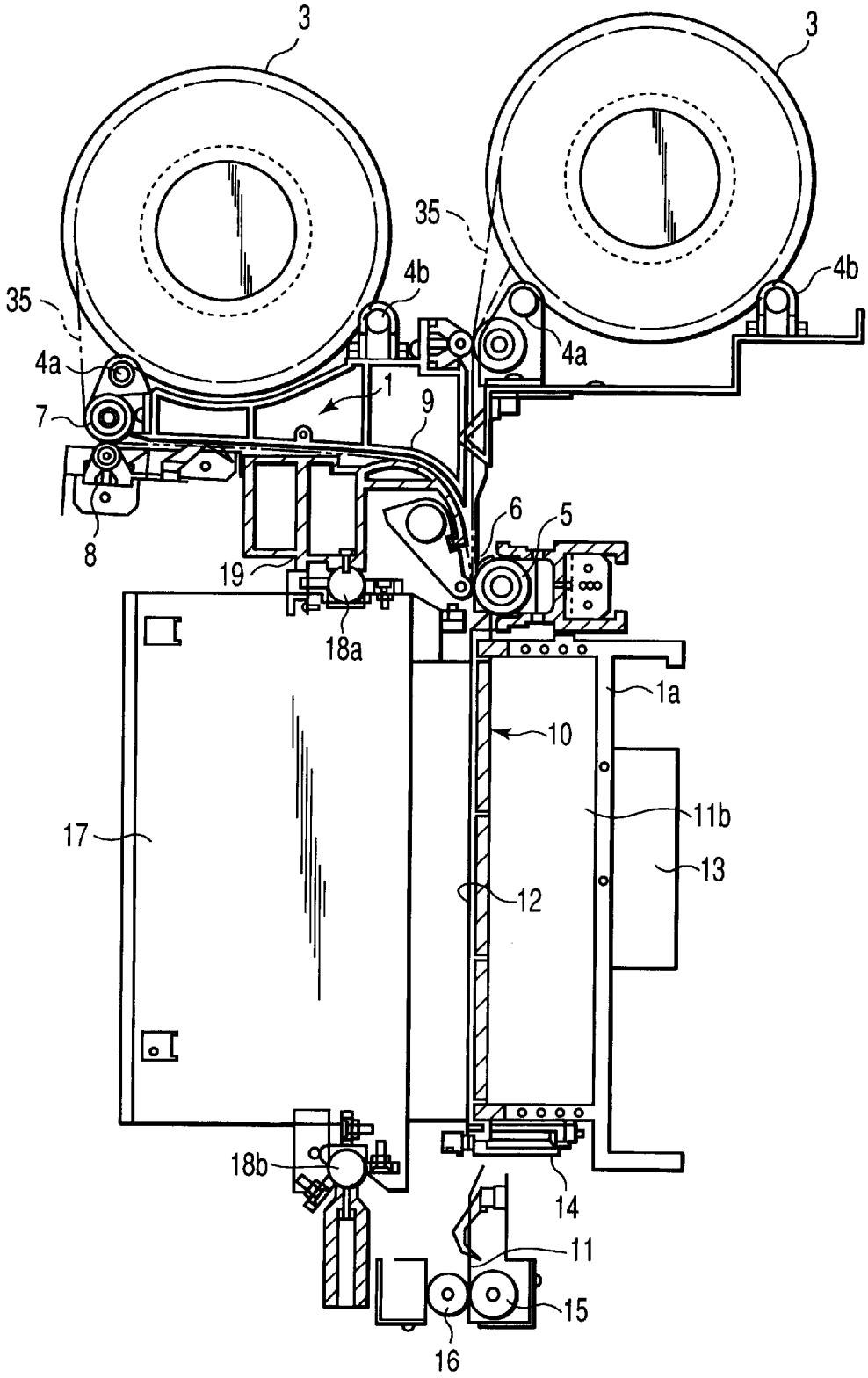
FIG. 1 is a view showing a constitution of an ink jet printer which is an application example of an image forming apparatus relating to a first embodiment of the present invention.
Figure 2B:
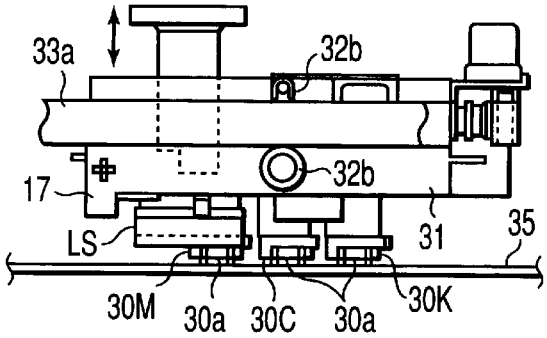
FIG. 2B is a schematic plan view of the main portions of the ink jet printer of FIG. 2A.
Figure 2A:
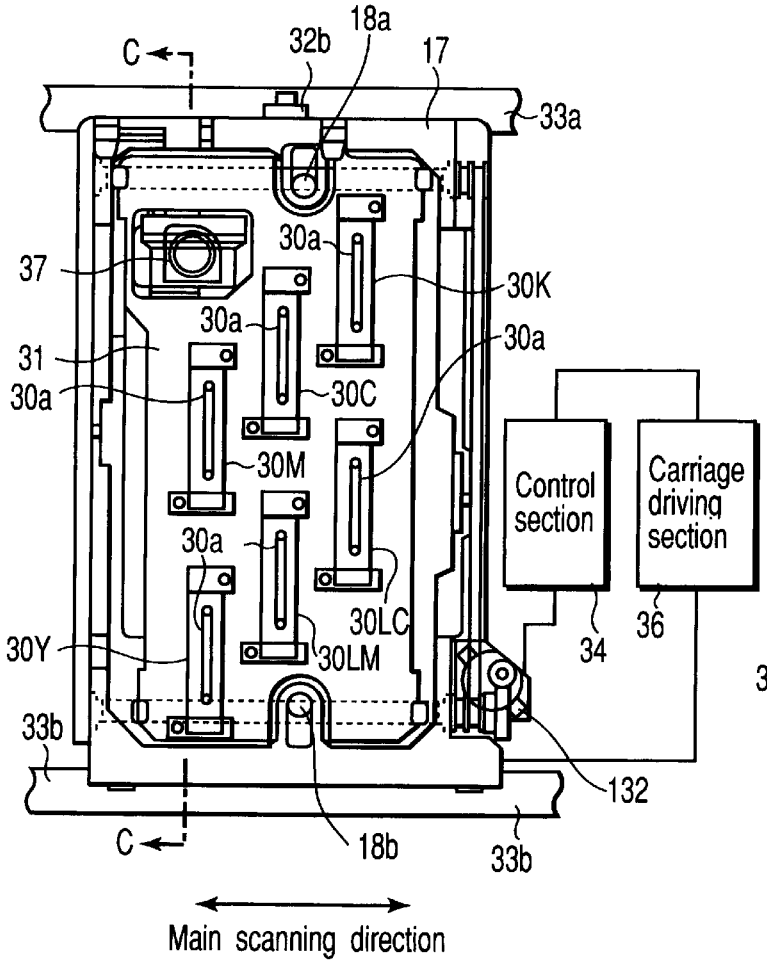
FIG. 2A is a schematic front view of main portions of an ink jet printer according to an embodiment of the present invention.
Figure 2C:
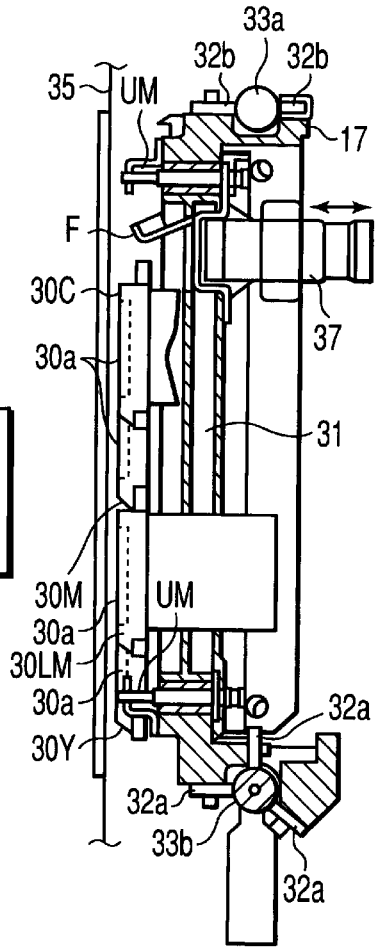
FIG. 2C is a schematic longitudinal sectional view of the main portions of the ink jet printer taken along the line C—C of FIG. 2A.

FIG. 1 is a view showing a constitution of an ink jet printer which is an application example of an image forming apparatus according to a first embodiment of the present invention. FIG. 2A is a schematic front view of main portions of an ink jet printer according to an embodiment of the present invention. FIG. 2B is a schematic plan view of the main portions of the ink jet printer of FIG. 2A. FIG. 2C is a schematic longitudinal sectional view of the main portions of the ink jet printer taken along the line C—C of FIG. 2A.

In FIG. 1, the ink jet printer relating to the first embodiment holds two print mediums 35, each wound in roll-from, at two positions separated in a longitudinal direction, at an upper portion of a support frame 1. A pair of disc-shaped print medium tube holders 3 are concentrically attached to the both ends of each rolled print medium 35, and are freely rotatably loaded on a pair of rolled print medium support rollers 4*a,* 4*b* provided at two positions in the longitudinal direction at the upper portion of the support frame 1.

At the support frame 1, a nipping point of a conveying roller 5 and a conveying pinch roller 6 is disposed lower than the region between the two rolled print mediums 35. The conveying roller 5 is formed by one roller which is slightly longer than the width of the print medium 35, and rotates by a predetermined speed in a predetermined direction by known driving means such as a motor (not shown).

Further, the conveying pinch roller 6 is formed by a plurality of freely rotating rollers separated from each other by predetermined intervals in the longitudinal direction of the conveying roller 5, and is urged toward the conveying roller 5 by urging means (not shown).

The rolled print medium 35 at the front, i.e., at the left side in FIG. 1, is pulled out up to the nipping point of the conveying roller 5 and the conveying pinch roller 6 via a nipping point of a front print medium feeding roller 7 and a front pinch roller 8, and via a front print medium guiding path 9.

Further, the front print medium feeding roller 7 rotates by a predetermined speed in a predetermined direction by known driving means such as a motor (not shown).

At the support frame 1, a platen 10 which functions as print medium supporting means is disposed at the rear side beneath the nipping point of the conveying roller 5 and the conveying pinch roller 6, i.e., at the right side in FIG. 1. A front surface 12 of the platen 10 spreads two-dimensionally in a print medium conveying direction and a print medium transverse direction. Further, a suction fan 13, which functions as sucking means for making a platen chamber 11*b* in negative pressure, is provided at a platen stay 1*a* which fixes the platen 10.

A print medium cutter 14 is attached to the bottom end portion of the platen stay 1*a*. A nipping point of a print medium discharging roller 15 and a print medium discharging pinch roller 16 fixed at the support frame 1 is disposed below the print medium cutter 14.

Further, in the first embodiment, the combination of the front print medium feeding roller 7 and the front pinch roller 8, the combination of the conveying roller 5 and the conveying pinch roller 6, and the combination of the print medium discharging roller 15 and the print medium discharging pinch roller 16 form print medium conveying means for conveying the front rolled print medium 11 in a predetermined direction.

At the support frame 1, a carriage 17, on which a plurality of ink jet heads which jet out plural types of inks having different concentrations are mounted, is disposed as image printing means in front of the platen 10.

Two movement guiding rods 18*a,* 18*b,* which extend horizontally in a state of being parallel to each other, are disposed above and below the carriage 17. The two movement guiding rods 18*a,* 18*b* are fixed to the support frame 1. The two movement guiding rods 18*a,* 18*b* are also parallel to the front surface of the platen 10, and are for guiding such that the carriage 17 can reciprocally move parallel to the platen 10. A linear encoder 19, for detecting a position of the carriage 17 in the print medium transverse direction, is disposed between the carriage 17 and the upper movement guiding rod 18*a,* 18*b.* The carriage 17 can reciprocally move along the two movement guiding rods 18*a,* 18*b* in a predetermined range by known reciprocal driving means (not shown). This predetermined range is from a home position of the carriage 17 to a reversing position at the time of reciprocal movement.

In FIGS. 2A, 2B and 2C, in the ink jet printer according to the present embodiment, six ink jet heads 30K, 30C, 30M, 30LC, 30LM and 30Y, which jet black (K), cyan (C), magenta (M), light cyan (LC), light magenta (LM) and yellow (Y) inks, are mounted on the carriage 17 in order to form images by full colors.

Further, the former three ink jet heads 30K, 30C and 30Y are disposed, so as to be sequentially offset toward one print medium transverse direction side of the platen 10 along the downward direction so as to not overlap each other in the print medium conveying direction, on the surface of the carriage 17 which faces the platen 10. Moreover, the latter three ink jet heads 30LC, 30LM and 30Y are disposed like the former three ink jet heads K, C and M, below the former three ink jet heads K, C and M.

Each of these six ink jet heads has a nozzle row L formed from a predetermined number of nozzles disposed at the same predetermined interval in the print medium conveying direction. The respective nozzle rows L are offset in the print medium transverse direction, but are disposed at the same predetermined interval if only the print medium conveying direction is considered.

Inks of corresponding colors are supplied via flexible and soft ink supplying tubes (not shown) by ink supplying pumps (not shown) from main ink bottles which are mounted on a fixing frame (not shown) of the ink jet printing apparatus and which contain black ink, cyan ink, magenta ink, light cyan ink, light magenta ink, and yellow ink.

The carriage 17 is supported so as to be movable in a predetermined range by a pair of guiding rods 33*a,* 33*b* which extend along a main scanning direction which is a first direction, i.e., in the horizontal direction in FIG. 2A. To explain more concretely, the pair of guiding rods 33*a,* 33*b* are separated in a sub-scanning direction which is a second direction, i.e., in the vertical direction in FIG. 2A. The carriage 17 is supported so as to be movable in a main scanning direction along the upper and lower guiding rods 33*a,* 33*b* by a plurality of rollers 32*b,* 32*a* provided above and below the carriage 17.

The carriage 17 has a square frame shape, and a head holding body 31 which holds six print heads is disposed in the central space thereof.

On the head holding body 31, optical image reading means (scanner) 37 is mounted so as to oppose to the print medium 35, and a light source LS which irradiates light toward a focal point F of the image reading means 37 is mounted.

In this first embodiment, the image reading means 37 is formed from a CCD (Charge Coupled Device), and the light source LS is formed from a small, power-saving light-emitting diode. Hereinafter, description will proceed by using numeral 37 for the CCD.

The carriage 17 is driven by a known carriage driving section 36, and is supported by the pair of guiding rods 33*a,* 33*b* so as to be reciprocally movable along the main scanning direction.

The known carriage driving section 36 is structured from a pair of pulleys (not shown) provided at both ends in the main scanning direction, a timing belt (not shown) fixed to the carriage 17 and spanning between the pair of pulleys, and a pulse motor (not shown) which drives one of the pair of pulleys. The pulse motor of the carriage driving section 36 is connected to a control section 34, and driving thereof is controlled by the control section 34. The flat platen 10 which supports the print medium 35 is disposed in front of each print head 30. A pulse motor 132 is connected to the control section 34.

The number of nozzles of each print head is 512. Two print heads disposed so as to be adjacent in the sub-scanning direction (for example, 30K and 30C, 30C and 30M, . . . ) are disposed such that only 16 dots overlap. Each print head has 512 nozzles, but at the time of image formation (except for the time of printing test patterns), only 496 nozzles thereof are used. Namely, the 8 nozzles at the each end are not used. Note that, all of 512 nozzles are used at the time of printing test patterns.

Figure 4:
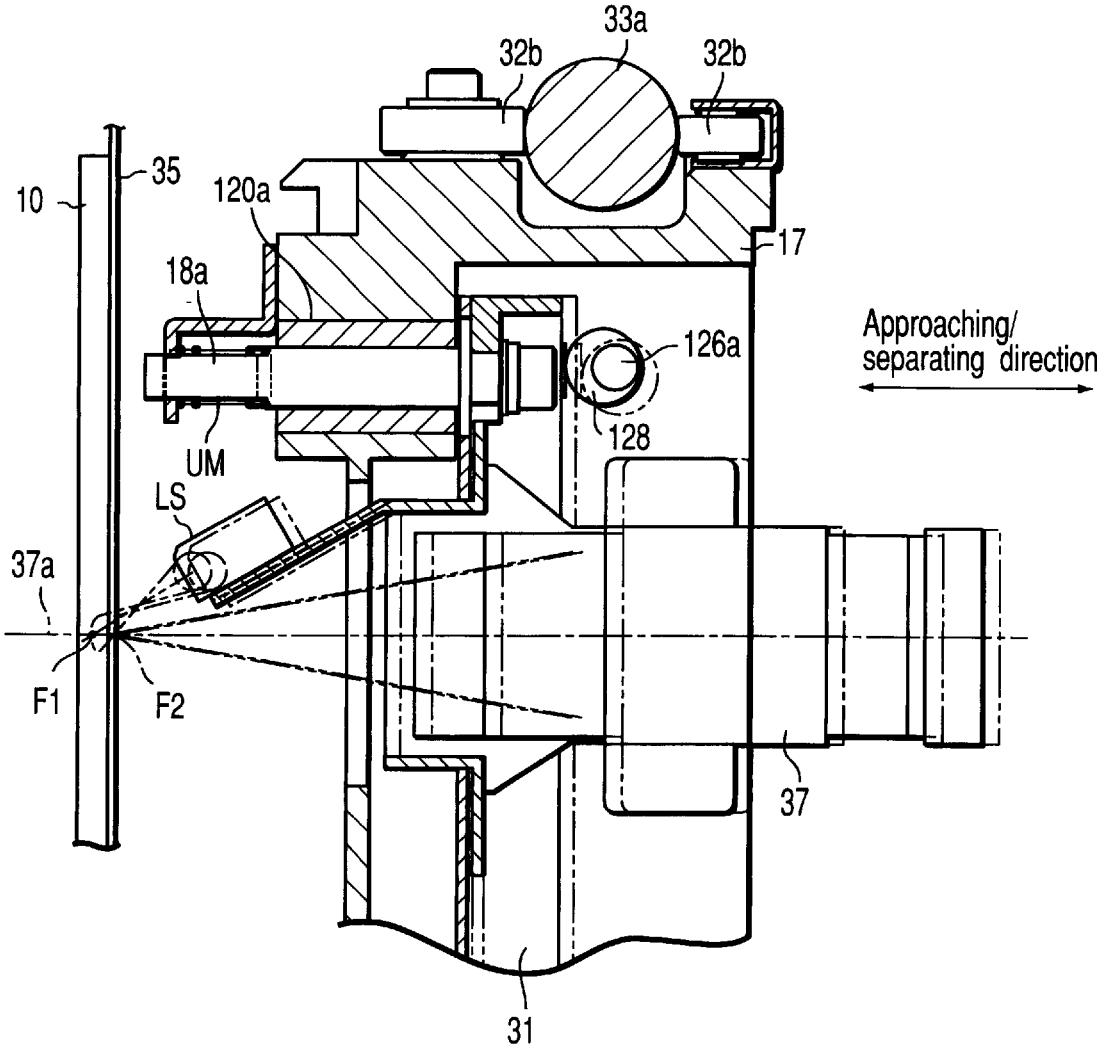
FIG. 4 is an enlarged longitudinal sectional view showing one portion (the upper portion) of the constitution of the head holding body taken along the line III—III in the ink jet printer of FIG. 2A.

The CCD 37 also is mounted on the carriage 17. This constitution is shown in FIG. 4. Although details will be described later, there are the three channels of R, G, B, and the imaging elements are formed in three lines in parallel along the main scanning direction.

Figure 3:
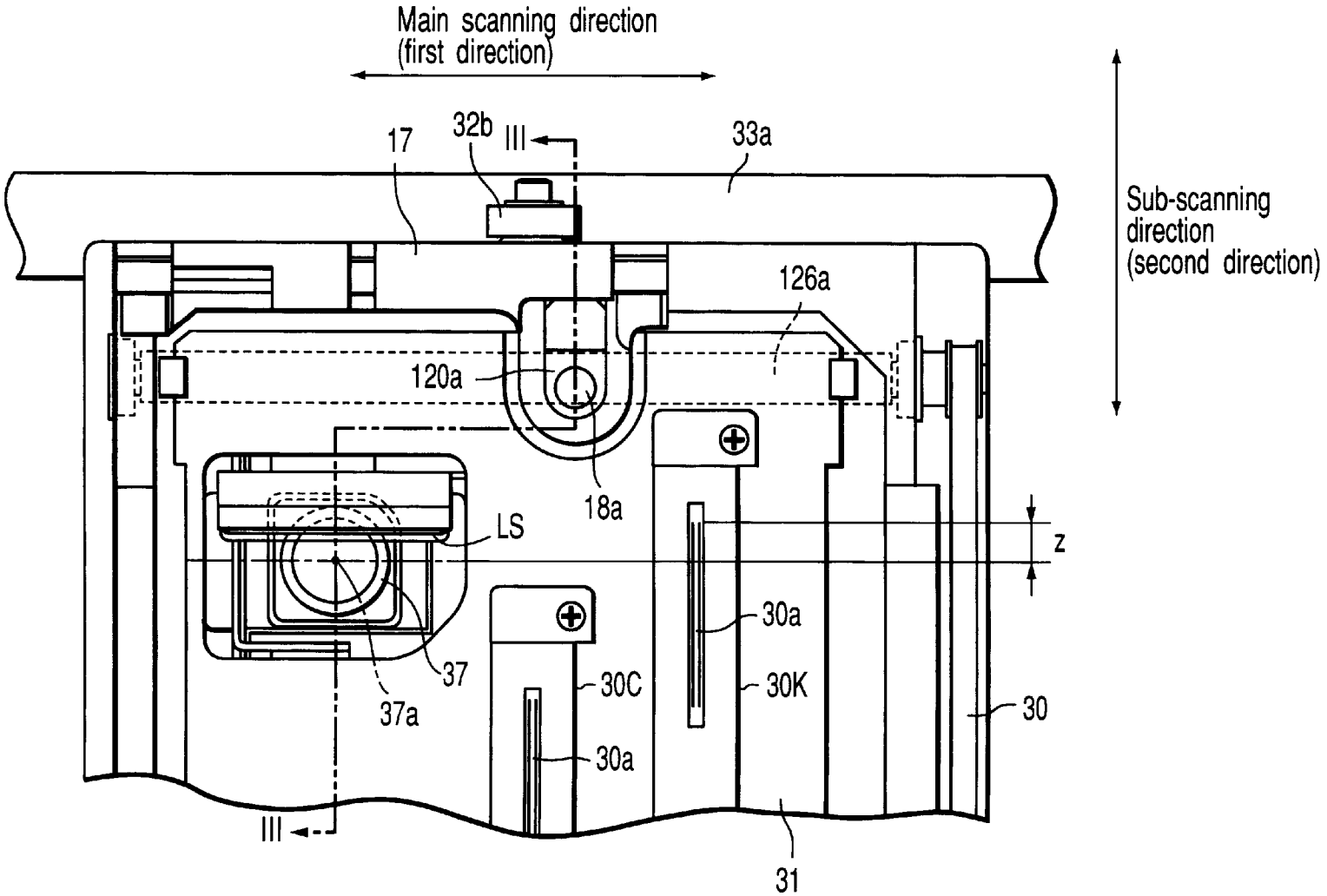
FIG. 3 is an enlarged front view showing one portion (an upper portion) of a constitution of a head holding body at which a CCD is provided in the ink jet printer of FIG. 2A.

FIG. 3 is an enlarged front view showing one portion (the upper portion) of the constitution of the head holding body 31 at which the CCD 37 is provided in the ink jet printer of FIG. 2A. As shown particularly well in FIG. 3, in the sub-scanning direction (the vertical direction in the figure), an optical axis 25*a* of the CCD 37 is disposed at a position separated by a distance Z below an ink jet nozzle 10*a,* disposed uppermost in the sub-scanning direction, of an ink jet head 10K disposed uppermost in the sub-scanning direction (most upstream in the print medium conveying direction).

In FIG. 3, 120*a* is a thrust bearing (outer carriage), 126*a* is a head holding body driving rod, and 130 is a timing belt.

FIG. 4 is an enlarged longitudinal sectional view showing one portion (the upper portion) of the constitution of the head holding body 31 taken along line III—III of FIG. 3 in the ink jet printer of FIG. 2A. FIG. 4 shows, by solid lines, the upper portion (the upper guiding rod 18*a,* the CCD 37, and the light source LS) of the head holding body 31 at the time of being closest to the print medium 35, and shows, by two-dot chain lines, the upper portion of the head holding body 31 at the time of being furthest away from the print medium 35. Note that, the other guiding rod 18*b* is omitted from the figure, because the relative position thereof with respect to the print medium 35 is similar to that of the guiding rod 18*a*. In FIG. 4, 128 is an eccentric cam.

Conveying of the print medium 35 is carried out by the conveying roller 5. The rotating direction and the number of rotations of the conveying roller 5 are controlled by a conveying motor (not shown).

The number of rotations of the conveying roller 5 is detected by a rotary encoder (not shown) structured from a radial pulse plate (not shown) fixed coaxially to the conveying roller 5 and a photo-interrupter (not shown) which detects the pulse plate.

The "count value" which is the detected results is outputted to the control section 34. Further, on the basis of the count results, the control section 34 controls the number of rotations of the conveying motor, and further, calculates the conveyed amount of the print medium.

Hereinafter, printing of test patterns will be described.

Printing of test patterns is carried out by one carriage scan. Test patterns of respective colors are printed so as to not overlap in the main scanning direction. Here, test patterns of K and C will be described, and descriptions of others are omitted.

Figure 5:
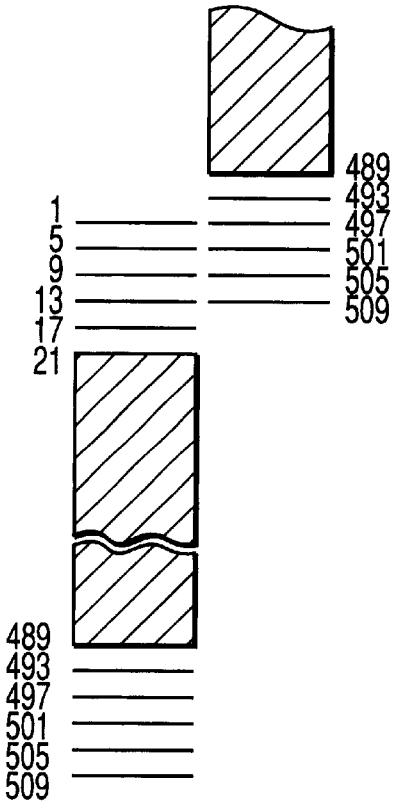
FIG. 5 is a diagram showing test patterns of K and C printed by the ink jet printer according to the first embodiment.

FIG. 5 shows and describes the test patterns of K and C. In FIG. 5, the left side is the test pattern of C, and the right side is the test pattern of K. When the carriage 17 is moved in the main scanning direction and reaches a predetermined position, the test patterns of K and C are printed by the print heads 30K and 30C.

With regard to the test pattern of K, five horizontal lines are printed at intervals of four dots from the first nozzle of the print head 30K. Namely, the 1st, 5th, 9th, 13th, and 17th nozzles are used. Further, so-called "solid printing" is carried out from the 21st nozzle to the 489th nozzle, and with regard to the nozzles after the 489th nozzle, printing is carried out at intervals of four dots. Namely, five horizontal lines are printed by using the 493rd, 497th, 501st, 505th, and 509th nozzles. Note that, as will be described later, because the five horizontal lines printed by the 1st, 5th, 9th, 13th, and 17th nozzles above the test pattern are not read by the CCD 37, it suffices to not print these five horizontal lines.

On the other hand, with respect to the test pattern of C, five horizontal lines are printed at intervals of four dots from the first nozzle of the print head 30C. Namely, the 1st, 5th, 9th, 13th, and 17th nozzles are used. Further, solid printing is carried out by using the 21st nozzle through the 489th nozzle, and five horizontal lines are printed at intervals of four dots after the 489th nozzle.

Looking at the test patterns printed on the print medium, the horizontal line printed by the 497th nozzle of the print head 30K and the horizontal line printed by the 1st nozzle of the print head 30C have the same position in the sub-scanning direction, and the horizontal line printed (actually not printed) by the 512nd nozzle of the print head 30K and the horizontal line printed (actually not printed) by the 16th nozzle of the print head 30C have the same position in the sub-scanning direction. Namely, the two print heads 30K and 30C which are adjacent in the sub-scanning direction overlap by 16 nozzles.

Next, reading of the test patterns by the CCD 37 will be described. Before reading of the test patterns, focal point adjustment of the CCD 37 is carried out, and this will be described later.

Figure 6:
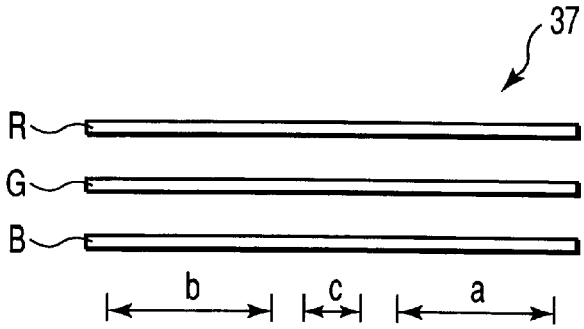
FIG. 6 is a diagram showing a state in which a CCD 37, adopted by the ink jet printer according to the first embodiment, is viewed from a platen 10 side.

In FIG. 6, a schematic constitution of the CCD 37 as viewed from the front side, i.e., from the platen 10 side, is shown and described. As shown in FIG. 6, the CCD 37 is functionally divided into a region b (corresponding to the left side in FIG. 6) which detects the test pattern of C, a region a (corresponding to the right side in FIG. 6) which detects the test pattern of K, and a region c (corresponding to the center in FIG. 6) which is set between the region a and the region b and which is not used for image reading.

The channel of the CCD 37 which is used in reading the patterns of K and C is R.

Namely, considering that it is necessary to use a channel which is different from the channel of the CCD 37 used at the usual time of reading one color and which is the most responsive channel for the two measured colors because two test patterns are read simultaneously by one scanning operation in the sub-scanning direction, here, channel R is selected. Usually, channel G is used for scanning only the test pattern of K, and channel R is used for scanning only the test pattern of C. Note that, the relation between the combination of the test patterns of the two colors which are scanned simultaneously and the channel of the CCD 37 which is used will be described in detail later.

When the test patterns of K and C are read simultaneously by one scanning, in a case where the channel which scans the test pattern of K is set to G and the channel which scans the test pattern of C is set to R, there is the need to take a "correction value" for correcting the sub-scanning direction interval between channel R and channel G of the CCD 37 into a "calculating expression" for deriving the appropriate position of the print head.

There is no problem if the interval between the channels is the same as that of a CCD 37 mounted in another printer. However, because there is dispersion among various machine types, there are cases in which the dispersion affects the position measurement of the test patterns in the sub-scanning direction.

With regard to this point, in the first embodiment, even when two test patterns are scanned simultaneously, by appropriately selecting the more responsive channel of the two test patterns, the affects of dispersion between the channels of the CCD 37 are reduced. This is one of the features of the present invention.

Next, relative movement of the print medium and the CCD 37 will be described.

The carriage 17 is moved such that the CCD 37 can read the test patterns of C and K at the same time. The position of the carriage at this time is stored as a predetermined position in a ROM (not shown) of the control section 34. By reading the value of the position from the ROM, the control section 34 moves the carriage 17 (coarse adjustment in the main scanning direction).

Further, the control section 23 conveys the print medium 2 such that the CCD 37 is positioned at the portion where the test pattern of C is solid-printed. At this time also, the detected output from the CCD 37 is turned off, and by reading a predetermined sub-scanning direction from the ROM (not shown), the control section 34 drives a conveying motor(coarse adjustment in the sub-scanning direction).

Next, at each predetermined pulse amount, the control section 34 applies a driving signal to the conveying motor, and conveys the print medium toward the sub-scanning direction lower side (the print medium conveying direction downstream side). Here, as 1/4 dot is considered to be 1 pulse, a driving signal of 1 pulse is applied to the conveying motor each one time. Namely, intermittent conveying of four times is needed in order to convey the print medium by 1 dot (1 nozzle). The detected output from the CCD (channel R) 37 is turned on after print medium conveying corresponding to 1 pulse has been carried out, and is inputted to the control section 34.

Figure 7A:
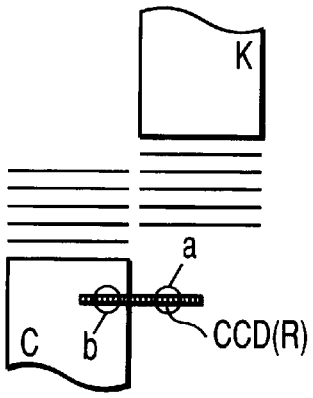
FIGS. 7A and 7B are diagrams for explaining a process in which test patterns of K and C are read by one scan by the CCD 37.
Figure 7B:
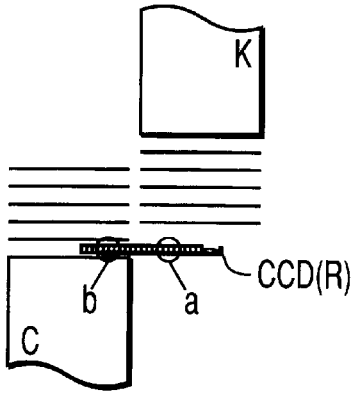

For example, in the state shown in FIG. 7A, a weak signal is inputted from the imaging element (which images the solid printed portion of C) in the region b of the CCD(R) 37, and a strong signal is inputted from the imaging element (which images the plain (blank) portion) in the region a. Then, the print medium is conveyed intermittently, and when the region b of the CCD(R) 37 moves away from the solid printed portion of the test pattern of C (refer to FIG. 7B), a strong signal showing the plain (blank) portion is, in the same way as the region a, outputted from the imaging element in the region b of the CCD(R) 37 to the control section 34.

Moreover, the control section 34 starts to count the number of pulses of the driving signal applied to the conveying motor, in accordance with the input of the strong signal. When intermittent conveying of the print medium continues to be carried out, the five horizontal lines, printed by the 17th nozzle, 13th nozzle, 9th nozzle, 5th nozzle, and 1st nozzle of the print head 30C, successively pass the region b of the CCD(R) 37. In this way, the control section 34 stores the inputted detection signals from the respective imaging elements in the region b of the CCD (channel R) 37, in a memory (not shown) at all times, in accordance with the print medium conveying number of pulses.

Figure 8A:
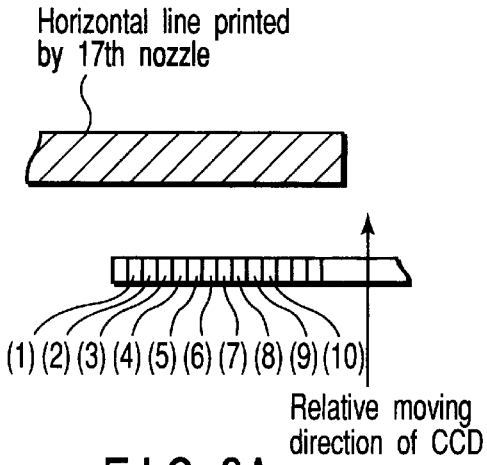
FIG. 8A is a view showing the relation of a test pattern and a relative moving direction of the CCD 37.

For example, as shown in FIG. 8A, supposing that there are 10 imaging elements in the region b, the signal levels detected by the respective imaging elements are outputted to the control section 34.

Figure 8B:
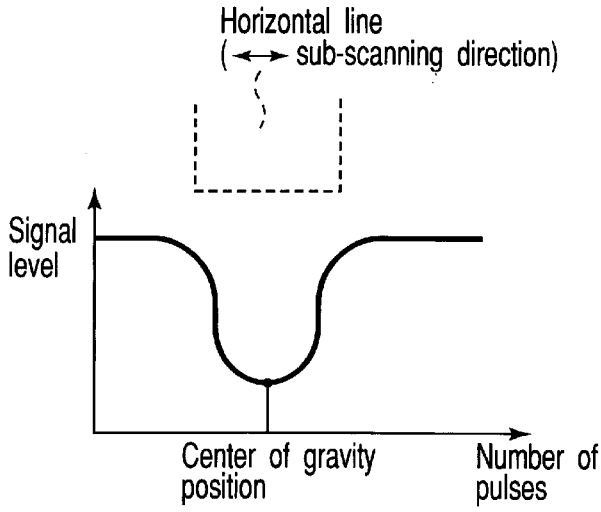
FIG. 8B is a graph showing a characteristic showing a number of pulses at a sub-scanning direction center of a horizontal line.
Figure 8C:
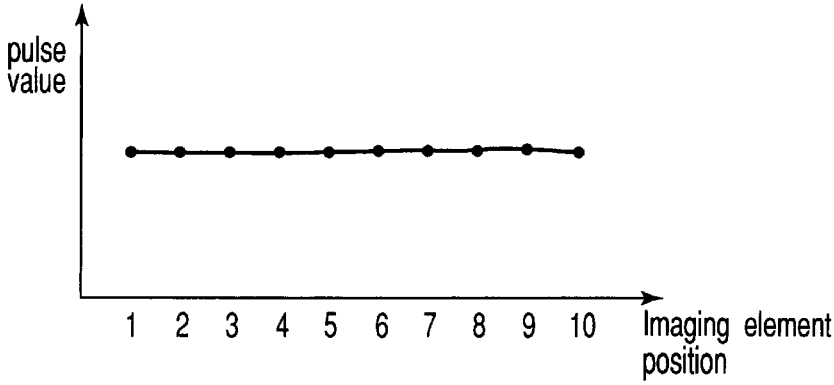
FIG. 8C is a graph showing an approximate straight line showing the relation of a position of an imaging element and a pulse value.

In the control section 34, the detected signals of the 10 imaging elements at the respective imaging positions are stored in the memory (not shown). Then, the control section 34 calculates, from the detected signals taken into the memory, the print medium conveying pulse value at the position where the level of the detected signal is low, i.e., at the sub-scanning direction center of the horizontal line (hereinafter called the center of gravity position) (refer to FIG. 8B). Then, the control section 34 determines an approximate straight line from the relation between the positions of the 10 imaging elements and the 10 pulse values corresponding to the center of gravity positions of the 10 imaging elements (refer to FIG. 8C). Note that, in this example, because the number of pulses at the respective center of gravity positions detected at the 10 imaging elements are substantially the same value, a slope does not arise at the determined approximate straight line (refer to FIG. 8C). This means that the CCD 37 is not mounted to the carriage 17 at an inclined state.

The control section 34 carries out the above processing for the horizontal lines printed by the 13th nozzle, 9th nozzle, 5th nozzle, and 1st nozzle, and the center of gravity positions of the respective horizontal lines and the sub-scanning direction positions (pulse values) thereof are calculated and stored in the memory. Similarly, also for the region a of the CCD 37, the control section 34 detects the respective center of gravity positions (pulse values) of the five horizontal lines of the test pattern of K, and calculates the positions to store them in the memory.

Figures 9A, 9B, 10, 11, 12:
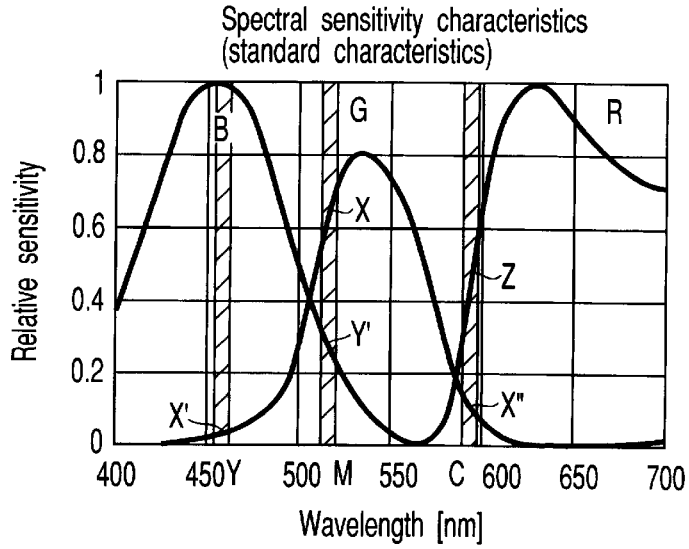
FIG. 9A is a table showing pulse values showing respective center of gravity positions of five horizontal lines of a test pattern of C detected in a region b of the CCD 37.
FIG. 9B is a table showing pulse values showing respective center of gravity positions of five horizontal lines of a test pattern of K detected in a region a of the CCD 37.
FIG. 10 is a table showing relations between measured colors and used channels.
FIG. 11 is a table showing relations between two measured colors and used channels.
FIG. 12 is a graph showing spectral sensitivity characteristics, with respect to wavelengths, for relative sensitivities of the three channels of B, G, R of the CCD 37.

Next, the pulse values showing the respective center of gravity positions of the five horizontal lines of the test pattern of K and the test pattern of C detected in the region a and the region b of the CCD 37 are shown in FIGS. 9A and 9B, and calculation of the amount of positional offset will be described in detail.

As shown in FIG. 9A, the mean value of the count values of the five numbers of pulses of the five horizontal lines is 46 for the region b of the CCD 37. As shown in FIG. 9B, the mean value of the count values of the five numbers of pulses of the five horizontal lines is 52 for the region a of the CCD 37. Here, for both test patterns of K and C, the positions of the third horizontal lines are the same as the mean positions of the five horizontal lines.

If the two print heads 30K and 30C are appropriately disposed on the carriage 17, a difference Y between the mean pulse values must be 16 (4 dots*4 counts/1 dot). However, an actual difference δ of the mean pulse values is 52−46=6. In this example, it can be understood that the two print heads 30K and 30C overlap excessively in the sub-scanning direction by 10 pulses (2.5 dots).

In the first embodiment, supposing that the position of the print head 30C is corrected on the basis of the print head 30K, a correction value ΔY (ΔY=δ−16) in the sub-scanning direction of the print head 30C is calculated, and is outputted to a display (not shown). The display format may be a pulse value, or may be a value in which the pulse value is converted into meters.

On the basis of the correction value calculated in this way, the operator adjusts the position of the print head 30C, by an amount corresponding to 10 pulses, downward in the sub-scanning direction, and fixes the print head 30C to the carriage 17. For details of the adjusting method, for example, the technique disclosed in Jpn. Pat. Appln. KOKAI Publication No. 11-295538 can be adopted.

In the first embodiment, the five horizontal lines of each of the two test patterns are detected by one scan operation of the CCD 37. If the precision of the correction values is to be increased, carrying out scanning operation of the CCD 37 plural times (for example, three times) and taking the mean value may be considered.

Further, although the number of horizontal lines printed at one end of the test pattern is 5, if it is desired to increase precision further, increasing the number of horizontal lines may be considered. In other words, if it is desired to make the adjusting time short, the number of horizontal lines may be decreased.

Next, the channels of the CCD 37 which is used will be described.

Usually, when there is one measured color, the used channels of the CCD 37 are as shown in FIG. 10. Namely, when the measured colors are K, M, LM, the used channel is G, and when the measured colors are C, LC, the used channel is R, and when the measured color is Y, the used channel is B. In the case of the first embodiment, regardless of the fact that there are two measured colors, one channel of the CCD 37 is used.

FIG. 12 shows the spectral sensitivity characteristics, with respect to wavelength, for the relative sensitivities of the three channels of B, G, R of the CCD 37. The abscissa shows the wavelength of light [nm], and the ordinate shows relative sensitivity. First, the case of one measured color is as follows.

Because the wavelength of the measured color Y is 430 to 480 nm, channel B, which has sufficiently high sensitivity at these the wavelengths, is used. Because the wavelength of the measured color M is 490 to 540 nm, channel G, which has sufficiently high sensitivity at these wavelengths, is used. Because the wavelength of the measured color C is 560 to 620 nm, channel R, which has sufficiently high sensitivity at these wavelengths, is used. Further, when the measured colors are LC, LM, although the frequencies thereof are slightly lower than C, M respectively, the channels R, G, are used in the same way as C, M, respectively. When the measured color is K, because the sensitivity is sufficient if any channel is used, here, the channel G is used.

Next, a case where there are two measured colors will be described.

In the first embodiment, the arrangements of the print heads are disposed in the order of K, C, M, LC, LM and Y from the sub-scanning direction upper side. Therefore, the combinations of two colors are the five types of K-C, C-M, M-LC, LC-LM and LM-Y.

Hereinafter, how the used channels of the CCD 37 for these respective five types of combinations are determined will be described with reference to FIG. 12.

First, a case where the combination of the measured colors is LM-Y will be described. In FIG. 12, G has sensitivities of sizes expressed by X, X' (X>X') with respect to LM, Y. B has sensitivities of sizes expressed by Y, Y' (Y>Y') with respect to LM, Y. On the other hand, R has a sensitivity of zero with respect to both LM, Y. Here, if the smaller sensitivities with respect to R, G, B are respectively selected, zero sensitivity for R, X' for G, and Y' for B are selected. Next, if the channel having the highest sensitivity thereamong is selected, channel B having Y' is selected.

Next, a case where the combination of the measured colors is LC-LM will be described. In FIG. 12, G has sensitivities of sizes expressed by X",X(X>X") with respect to LC, LM. B has a sensitivity of a size of Y' with respect to LM, and has zero sensitivity with respect to LM. Further, R has a sensitivity of a size of Z with respect to LC, and has zero sensitivity with respect to LM. Here, if the smaller sensitivities of R, G, B are respectively selected, zero sensitivity for R, X"for G, and zero sensitivity for B are selected. Next, if the channel having the highest sensitivity thereamong is selected, channel G having X" is selected.

The case where the combinations of the measured colors are K-C, C-M, M-LC is similar.

In this way, in the present embodiment, the control section 34 selects for R, G, B, the measured colors having lower sensitivities, and uses the channel of the measured color having the highest sensitivity thereamong. Namely, in the present embodiment, when two test pattern images of different colors among a plurality of test patterns are read, a CCD to which is applied a color filter, which is such that the sensitivity of the test pattern image having the lowest sensitivity is made to be the highest sensitivity, is used.

It should be noted that in this printer, the relationship between a combination of two measured colors to be read and a color filter of the CCD 37 which is used when the two measured colors are read, is determined in advance in accordance with the above described method, and is stored in a memory.

FIG. 11 shows the channels of the CCD 37 selected for the respective measured colors on the basis of the above-described method. Concretely, if the combination of the measured colors is K-C, channel R is selected for use, and if the combinations of the measured colors are C-M, M-LC, LC-LM, channel G is selected for use, and if the combination of the measured colors is LM-Y, channel B is selected for use.

Next, affects of inclination and correction of inclination of the CCD 37 will be described.

If the CCD 37 is mounted at an incline on the carriage 17, the correct correction value cannot be calculated, and there is the fear that detection of the horizontal lines cannot be carried out. Therefore, in the first embodiment, as described above, an approximate straight line is determined on the basis of the ten center of gravity positions detected from the ten imaging elements respectively.

When the component of the slope is superimposed on the approximate straight line, the CCD 37 is mounted at an incline to the carriage 17. Therefore, in accordance with the amount of inclination of the CCD 37, there is the need to add a correction value to the pulse value (count value) of each center of gravity position.

Note that, in order to determine to what extent the amount of inclination of the CCD 37 is, it is preferable that many horizontal lines are detected. In the first embodiment, by detecting ten horizontal lines of each of the two test patterns, the precise inclination amount is calculated, and is used for detecting the center of gravity positions. Hereinafter, this will be described in detail.

Namely, in the first embodiment, it is assumed that the numbers of the imaging elements used for image reading in the region a and the region b of the CCD 37 are respectively 10, and the number the of imaging elements in the region c is 10. At a CCD used in an actual product, 700 are assigned for regions a and b, and 600 are assigned for the region c.

In this case, given that the detected slope is θ (refer to FIG. 14), the distance from the center of the region a to the center of the region b (10/2+10+10/2) is L, and the coefficient for converting into pulse units is α, a slope correction value D is determined by the following equation.

$$D=\theta*L*\alpha \quad (1)$$

Here, it is assumed that D is 2 pulses. If slope correction is carried out for the count (pulse) values detected in the region b (i.e., if the correction value D is added), the five pulse values of the five horizontal lines are as shown in FIG. 13.

In the previous example described by using FIGS. 9A and 9B, because the mean pulse value in the region a is 52 and the mean pulse value in the region b is 48, the difference δ2 between the mean pulse values is 52−48=4 pulses. Originally, because there must be offset by 4 dots (i.e., 16 pulses), a sub-scanning direction correction value ΔY2 (ΔY2=δ2−16) of the print head 30C is 12, and the print head 30C overlaps excessively in the sub-scanning direction by 12 pulses, i.e., 3 dots. The excessively overlapping print head 30C is adjusted in the same way by the above-described adjusting method or the like.

Note that, as described above, in computing the slope θ, the correction value D is determined by above equation (1) by assuming that the distance between the centers (the centers of gravity) of the two regions a and b is L. However, the distance defined by these centers of gravity is of course invariable, even if the coordinate system is varied by changing the reading direction of the CCD 37 or the like. Such slope computation can be incorporated into a usual process of computing positional offset.

In the above-described first embodiment, a line sensor is used as the CCD, but an area sensor may of course be used.

When an area sensor is used, the control section images all of the ten horizontal lines, and stores the obtained image data in a memory. Then, at the memory, the center of gravity positions of the horizontal lines of the respective test patterns and the mean center of gravity positions are determined, and by calculating the intervals of the center of gravity positions of the respective test patterns, the correction value can be calculated. In this way, when an area sensor is used, because there is no need to convey the print medium at the time of scanning, affects such as print medium conveying errors or the like can be further reduced.

Next, a second embodiment of the present invention will be described.

Here, points different from the first embodiment will be mainly explained.

Although only the positional relationship between the print heads 30K, 30C was described in the first embodiment, there is need to adjust other print heads.

Namely, with regard to the positional relationships of the print heads 30C, 30M, the print heads 30M, 30LC, the print heads 30LC, 30LM, and the print heads 30LM, 30Y, by printing similar test patterns by one carriage scan and detecting the positions of the five horizontal lines of each test pattern, the sub-scanning direction positions of the respective heads are adjusted.

The arrangement of the test patterns of the six colors on the print medium in accordance with the above-described first embodiment is shown in FIG. 15A. In contrast, the arrangement of the test patterns of the six colors in accordance with the second embodiment is as shown in FIG. 15B. Namely, as shown in FIG. 15B, printing may be carried out along the sub-scanning direction. Note that the hatched portions in these figures correspond to the portions at which the horizontal lines are formed.

In the case of the test pattern shown in FIG. 15B, by deciding the start-of-scan position (the main scanning direction position) of the CCD 37, there is no need to change the main scanning direction position of the CCD 37 when all of the test patterns are scanned, and time required for position adjustment can be shortened. Further, because there is no need to move the carriage 17 (it is assumed that there is no slanted conveying), it contributes to a savings in power.

Next, a third embodiment of the present invention will be described.

Figure 16A:
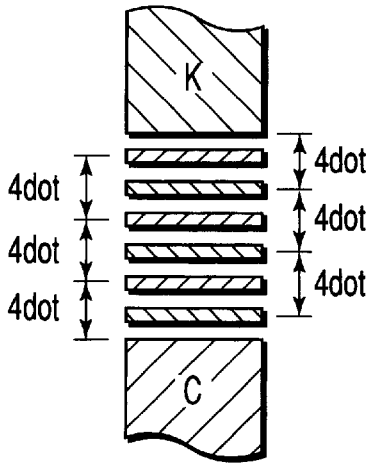
FIG. 16A is a diagram showing test patterns in accordance with a third embodiment of the present invention.

In the third embodiment, test patterns as shown in FIG. 16A are used. Namely, as shown in FIG. 16A, two test patterns are printed being overlapped in the main scanning direction, and horizontal lines (here, three horizontal lines at intervals of 4 dots) are alternately disposed (here, at intervals of 2 dots).

In this case, the channel used by the CCD 37 is channel R, and in the case of channel R, the response level is higher with respect to the test pattern of C than that of K.

Figure 16B:
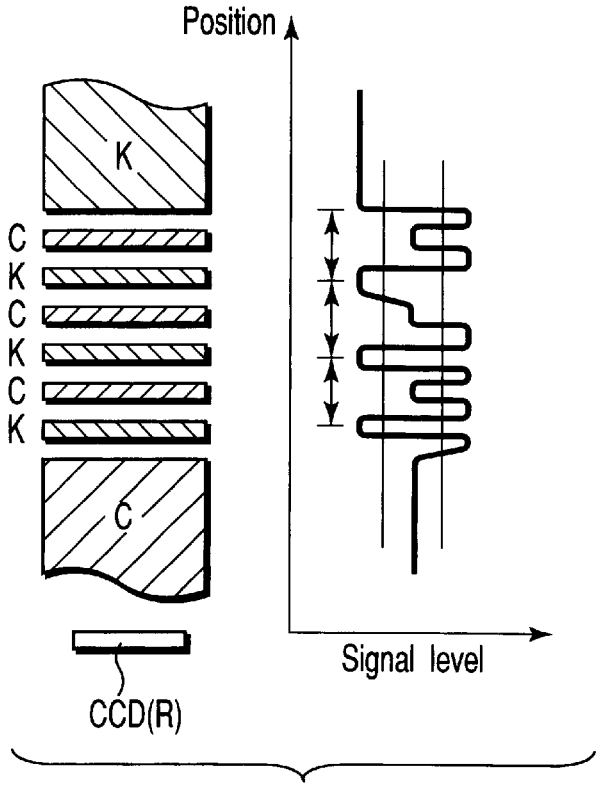
FIG. 16B is a diagram showing a signal obtained by reading the test patterns of FIG. 16A.

Accordingly, if the CCD 37 is disposed at the main scanning direction center of the two test patterns and on the solid printed portion of the test pattern of C, and scanning is started, the obtained signal is as in FIG. 16B. In order of strength of the signal levels, the plain (white) portion, the C portion, and the K portion are separate, and their respective center of gravity positions can be distinguished.

Then, the center of gravity positions of three horizontal lines of the test pattern of K are respectively determined, and the mean position is calculated. Further, the center of gravity positions of three horizontal lines of the test pattern of C are respectively determined, and the mean position is calculated.

Then, a correction value, for making the difference between the mean positions become a number of pulses corresponding to 2 dots, is calculated, and the correction value is displayed on a display device (not shown).

In the above-described third embodiment, the horizontal lines of the two test patterns overlap on each other, and there is the fear that, even if the horizontal lines can be detected, it cannot be determined which color test pattern the horizontal lines belong to.

Figure 16C:
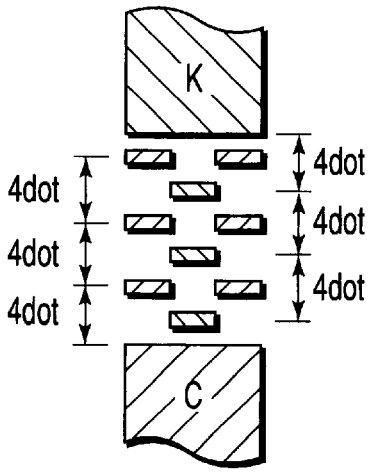
FIG. 16C is a diagram showing test patterns according to an improved example of the third embodiment.

In consideration of this point, the test pattern arrangement shown in FIG. 16C can be adopted as a modified example of the third embodiment.

In this modified example, although the positions, in the sub-scanning direction, of the three horizontal lines of each test pattern (strictly speaking, the horizontal lines of the test pattern of C are broken lines) are the same as in the third embodiment, the positional relationship is such that the horizontal lines do not overlap each other in the main scanning direction. By making such horizontal lines, even if the print head 30K and the print head 30C are offset by two dots from the state shown in FIG. 16C and the horizontal lines overlap each other in the sub-scanning direction, the horizontal lines are printed so as to be offset in the main scanning direction, and the horizontal lines of the test pattern of C are not printed so as to overlap on the horizontal lines of the test pattern of K. Therefore, even if scanning is carried out by the CCD 37, due to the position in the main scanning direction, it is possible to determine to which test pattern the read horizontal line belongs.

Figure 16D:
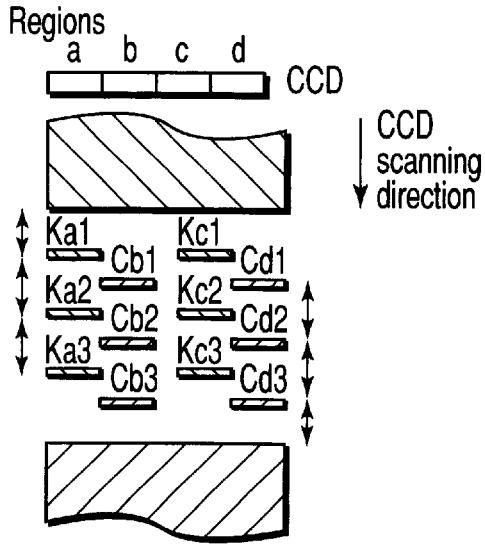
FIG. 16D is a diagram showing test patterns according to a further improvement of the third embodiment.

Moreover, the test pattern arrangement shown in FIG. 16D can be adopted. In this modified example of the third embodiment, the three horizontal lines of each test pattern are broken lines. Namely, the sub-scanning direction positions thereof are the same way as in the third embodiment, and there is a positional relationship in which the horizontal lines do not overlap in the main scanning direction.

In this case, the reading region of the line sensor is divided into a, b, c and d as shown in the figure. In the respective regions a, b, c and d, the sub-scanning direction positions (the number of steps) of the complementary horizontal lines are held. Then, the mean value of horizontal lines Ka1 and Kc1 is made to be K1, and the mean value of horizontal lines Cb1 and Cd1 is made to be C1, and in the same way, the mean value for K2, K3, C3 is determined. Then, the mean value (Kavg) of K1, K2, K3 and the mean value (Cavg) of C1, C2, C3 are determined. A correction amount for making the difference between Kavg and Cavg 2 dots is the head position correction amount in the sub-scanning direction.

By adjusting the positional relationship of the horizontal lines by this correction amount, even if the print head 30K and the print head 30C are offset by two dots from the state shown in FIG. 16D and the horizontal lines overlap each other in the sub-scanning direction, because the horizontal lines are printed to be offset in the main scanning direction, the horizontal lines of the test pattern of C are not printed to overlap on the horizontal lines of the test pattern of K.

Next, a fourth embodiment of the present invention will be described.

In the above-described embodiments, two adjacent print heads are disposed on the carriage such that the nozzles thereof overlap, and the positional adjustment of the heads is carried out on the basis of the results of printing from the nozzles of the overlapping portions. However, the fourth embodiment is not limited to the case where two print heads overlap in the sub-scanning direction, and can be applied to a case where the heads do not overlap.

Figure 17:
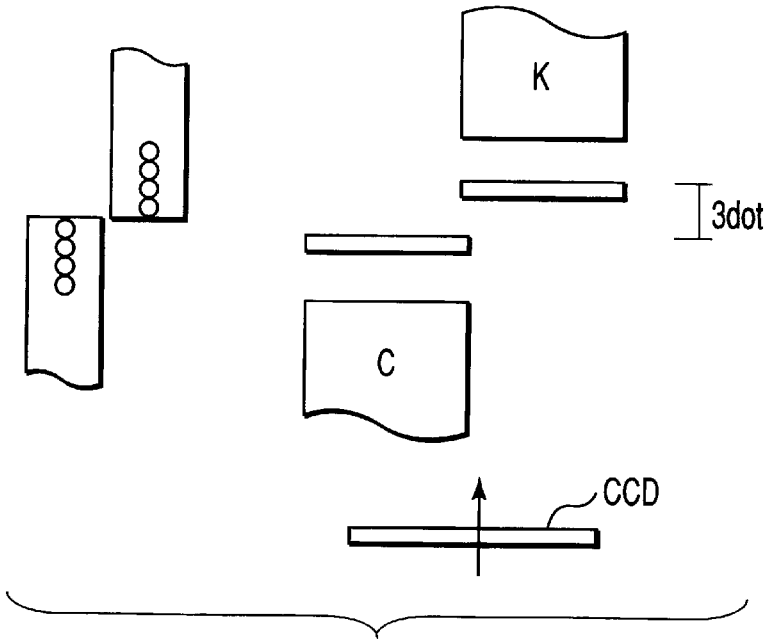
FIG. 17 is a diagram showing an arrangement of test patterns in accordance with a fourth embodiment of the present invention.

Here, the test pattern which is adopted in the fourth embodiment of the present invention will be described with reference to FIG. 17. In this example, the print heads 30K, 30C are fixed on the carriage 17 such that the sub-scanning direction bottommost end nozzle of the print head 30K and the sub-scanning direction uppermost end nozzle of the print head 30C are disposed so as to be offset by 1 dot.

The test pattern of K is formed by turning the 1st through the 508th nozzles and the 511th nozzle of the print head 30K ON (print), and turning the 509th, 510th, and 512th nozzles OFF. On the other hand, the test pattern of C is formed by turning the 2nd, the 5th through the 508th nozzles and the 511th nozzle of the print head 30C ON (print), and turning the 1st, 3rd, 4th, 509th, 510th and 512th nozzles OFF. Note that the method of scanning of the CCD 37 is the same as in the first embodiment, and because there is one horizontal line, "averaging the center of gravity positions" is unnecessary in this example.

In the case of the fourth embodiment, it can be considered that the print head 30K and the print head 30C are disposed at optimal positions if the difference between the center of gravity position of the horizontal line of the test pattern of K and the center of gravity position of the horizontal line of the test pattern of C becomes the number of pulses of 3 dots. Thus, the number of pulses corresponding to 3 dots and the number of pulses of the difference of the two horizontal lines are actually compared, and the difference is made to be the correction value.

The first through fourth embodiments have been described above. However, the present invention is not limited to the same, and various improvements and changes are possible within a range which does not deviate from the gist of the present invention. For example, in the above-described embodiment, although a horizontal line is formed by one nozzle, the horizontal line may be formed by a plurality of adjacent nozzles. Namely, the test pattern can be formed in units of blocks, and not lines. This case is similar with respect to the point that the center of gravity position (the center of gravity position of the block) is determined.

As described above in detail, according to the first through fourth embodiments, an image forming apparatus, which can easily detect the sub-scanning direction positional offset between a plurality of print heads and which can adjust the positional offset precisely while reducing the affects of print medium conveying errors, can be provided.

In further detail, the present invention can provide an image forming apparatus which carries out highly precise positional adjustment in which the affects of print medium conveying errors are reduced, by reading a plurality of test pattern images by one sub-scan and detecting the sub-scanning direction positional offset of the print heads which formed the test pattern images. Further, the present invention can provide an image forming apparatus, which reduces the affects of print medium conveying errors and aims to improve reading precision, by selecting an imaging element to which is applied a color filter, which is such that the sensitivity of the test pattern image having the lower sensitivity between the two test pattern images is made to be the highest sensitivity, and by reading the two test pattern images by one sub-scanning.

Figure 18A:
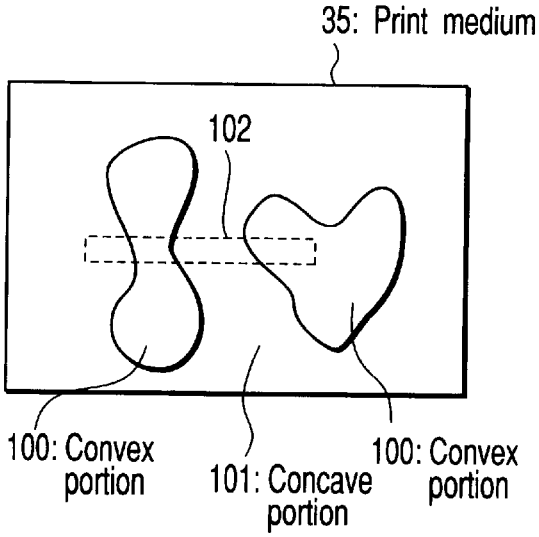
FIGS. 18A and 18B are diagrams showing convex and concave portions on the surface of a print medium 35 such as a paper, a cloth, a plastic film or the like, in a fifth embodiment of the present invention.
Figure 18B:
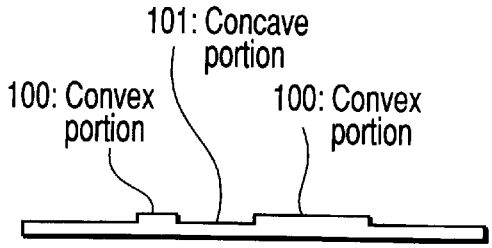

Next, a fifth embodiment of the present invention will be described. The fifth embodiment relates to a focal point adjusting method for the CCD 37. The surface of the print medium 35, cloth, plastic film or the like serving as a printing medium is not flat, and if enlarged, the print medium 35 has a concave portion 101 and convex portions 100 as shown in FIGS. 18A and 18B. Thus, the present embodiment has the feature that such convexity/concavity information of the print medium 35 is taken in by the CCD 37 and focusing of the CCD 37 is carried out. The CCD 37 in the present embodiment is formed by disposing a plurality of imaging elements in a line. In FIG. 18A, 102 is a reading region of the CCD 37. Note that a CCD at which a plurality of imaging elements are disposed in an area form may be used.

Figure 19:
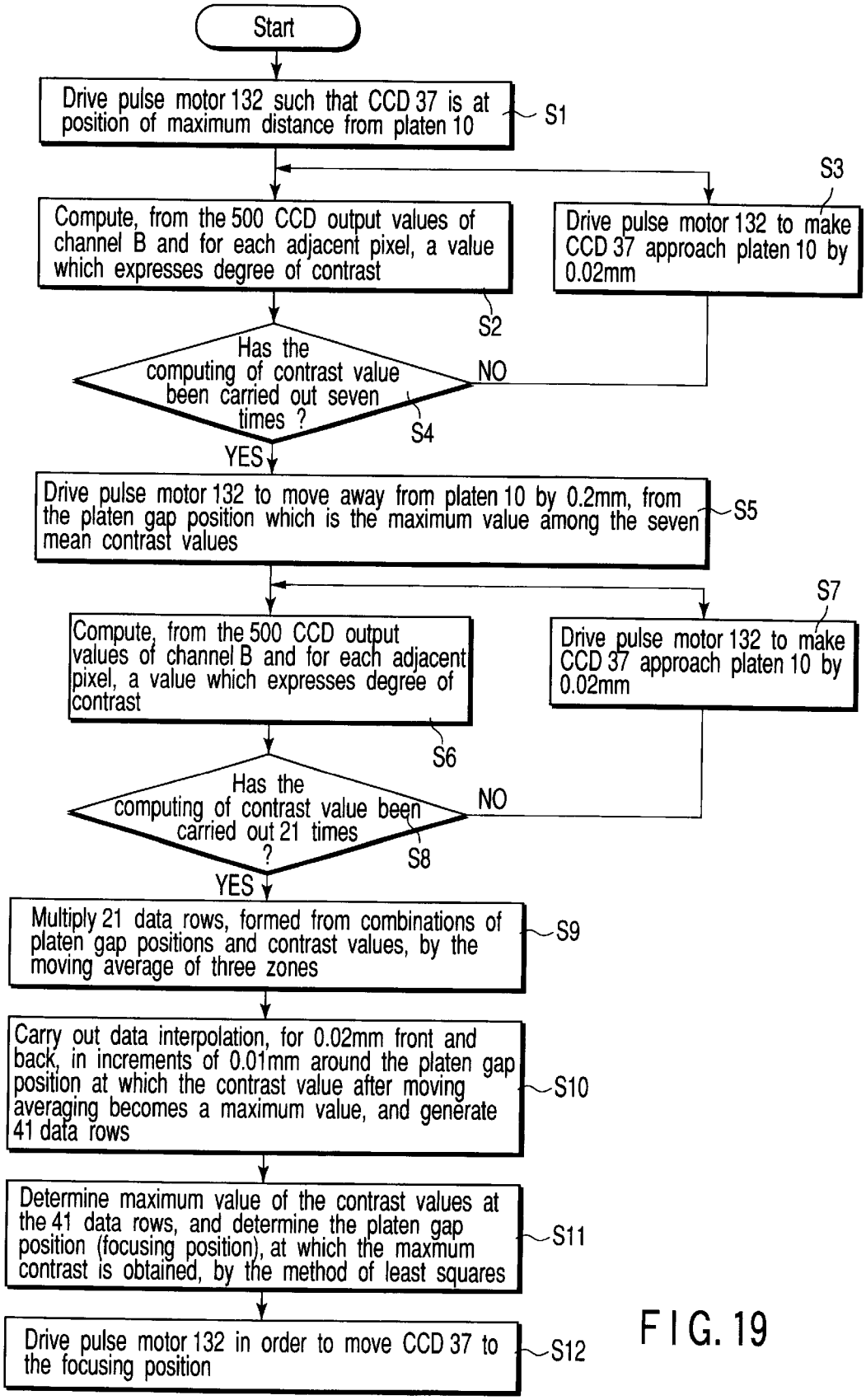
FIG. 19 is a flowchart for explaining details of a focal point adjusting method according to the fifth embodiment.

FIG. 19 is a flowchart for explaining details of the focal point adjusting method relating to the fifth embodiment. Here, it is assumed that the convexity/concavity information of the blank portion, on which no image for a test pattern is printed, of the print medium 35 is taken in. First, the control section drives a pulse motor 132 by a predetermined amount such that the CCD 37 is moved to a position of a maximum distance with respect to the platen 10. Next, a value expressing the degree of contrast is computed for each adjacent pixel from the 500 CCD output values of channel B in the CCD 37, and these values are set in correspondence with the reading positions of the CCD 37, and are stored in a memory (not shown) (step S2). Namely, on the basis of the output values from 500 CCD pixels in channel B, the differences (contrast values) of the output values of the respective adjacent pixels are computed. 499 contrast values are thereby obtained.

It should be noted that when a value expressing the degree of contrast is computed, the differences of the output values of the respective every other pixels or the respective every third pixels, rather than the respective adjacent pixels, can be computed. The contrast value obtained from this method is 498 or 497.

Next, the control section moves the CCD 37 by 0.2 mm per movement by driving the pulse motor, and each time, a contrast value is computed from the output values of the CCD pixels. This operation is carried out seven times. Namely, in step S4, the control section determines whether or not computing of the contrast value has been carried out seven times. In the case of NO, in step S3, the pulse motor 132 is driven by a predetermined amount in order to make the CCD 37 move closer to the platen by 0.2 mm. Thereafter, the routine returns to step S2, and a value which expresses the degree of contrast is computed again from the 500 CCD output values of channel B. These processings are carried out until computing of the contrast value is executed seven times, and when it is carried out seven times, the routine proceeds to step S5.

In step 5, firstly, the mean value of the 499 contrast values computed in the former step is calculated. Because measurement is carried out seven times, seven measured values are obtained in all. A platen gap position which is the maximum value among the seven mean values is calculated, and the pulse motor 132 is driven by a predetermined amount so as to move, by 0.2 mm from the platen gap position, further away from the platen 10.

Next, a value which expresses the degree of contrast is computed for each adjacent pixel from the 500 CCD output values of channel B, and is stored in a memory (not shown) in correspondence with the reading position of the CCD 37 (step S6). Next, whether or not computing of the contrast value has been carried out 21 times is determined (step S8). In the case of NO, in step S7, the pulse motor 132 is driven by a predetermined amount in order to make the CCD 37 move toward the platen by 0.2 mm. Thereafter, the routine returns to step S6, and a value which expresses the degree of contrast is computed again for each adjacent pixel from the 500 CCD output values of channel B. These processings are carried out until computing of the contrast value is executed 21 times. When it is carried out 21 times, the routine proceeds to step S9, and the twenty-one data rows formed from the combination of the platen gap position and the contrast value is multiplied by the moving average of three zones. Here, "twenty-one data rows" is obtained from the result of computing the mean value of the contrast values after measurement is carried out 21 times. Further, "is multiplied by the moving average of three zones" means processing such as the following.

If the contrast values are set on the ordinate and the platen gap positions are set on the abscissa, twenty-one data are plotted on the graph. Here, the mean value of three data at each of 49.98 mm, 50 mm, 50.02 mm at the platen gap position is calculated. The mean value is plotted at the platen gap position of 50 mm. Next, the mean value of three data at each of 50 mm, 50.02 mm, 50.04 mm is calculated, and the mean value is plotted at the 50.02 mm position. This computing is repeatedly carried out, and all of the twenty-one data rows are multiplied by the moving average of three zones.

If the initial twenty-one plotted points are connected, a zigzagged graph is formed. However, by executing this step, a rather smooth curve is obtained.

Next, data interpolation at the sections 0.02 mm front and back is carried out in increments of 0.001 mm around the platen gap position at which the contrast value after moving averaging becomes a maximum value, and 41 data rows are generated (step S10). Namely, in step S10, by inputting, into a predetermined function (which is previously had), the 21 platen gap position data and the 21 contrast values corresponding thereto, as well as the platen position interval which is the increment (0.001 mm) and the platen gap range (0.02 mm at the front and rear), a total of 41 contrast values, which until now could only be obtained at intervals of 0.02 mm, are obtained at intervals of 0.001 mm.

This is the step carried out on the basis of the assumption that the platen gap position at which the maximum value among the 21 contrast values is plotted is not necessarily the actual platen gap, and the actual platen gap may be in the interval of 0.02 mm at the front and rear.

Next, at the 41 data rows, the maximum value of the contrast values is determined, and the platen gap position, at which the maximum contrast is obtained, is determined as the focusing position by the method of least squares (step S11). Namely, in step S11, on the basis of the 41 data generated in the previous step, by the method of least squares, $y=ax^2+bx+c$ is determined, and then, differential computation is carried out. Namely, $dy/dx=2ax+b$. If $dy/dx=0$, the slope is 0, i.e., is an extreme. (Here, extreme means maximum value.) Thus, the value of x which makes dy/dx=0 is determined. Here, the determined value of x is the platen gap position which obtains the maximum contrast value. In this way, the platen gap position at which the contrast value is the maximum value can be determined.

Next, in order to move the CCD 37 to the determined focusing position, the control section drives the pulse motor 132 by a predetermined amount (step S12).

If the control section judges that the focal point of the CCD 37 is the same as the position of F2 on the surface of the print medium 35, either the print medium 35 is moved in the sub-scanning direction in a state in which the head holding body 31 is held at that position, or the carriage 17 is moved in the main scanning direction, and the region of the image for which evaluation is desired is read by the CCD 37.

According to the above-described embodiment, movement of the CCD 37 is controlled on the basis of the convexity/concavity information of the blank portion, at which no image as a test pattern is printed, on the surface of the print medium which is read from the CCD 37. Thus, the focal point of the CCD 37 can be adjusted well without any particular need for a region, ink and time for the test pattern in order to adjust the focal point.

According to the above-described fifth embodiment, an ink jet printer and a focal point adjusting method of the CCD 37, in which the focal point of the CCD 37 can be adjusted well without any particular need for a region, ink and time for the test pattern in order to adjust the focal point, can be provided.

Additional advantages and modifications will readily occur to those skilled in the art. Therefore, the invention in its broader aspects is not limited to the specific details and representative embodiments shown and described herein. Accordingly, various modifications may be made without departing from the spirit or scope of the general inventive concept as defined by the appended claims and their equivalents.

What is claimed is:

1. An image forming apparatus comprising:

a plurality of print heads;

a scanner which reads an image printed by the plurality of print heads;

a main scanning mechanism which causes the plurality of print heads and the scanner to perform main scanning relative to a printing medium;

a sub-scanning mechanism which causes the plurality of print heads and the scanner to perform sub-scanning relative to the printing medium; and a control section which calculates an amount of positional offset of each print head in accordance with a position of an image read by the scanner, the image forming apparatus carrying out image formation by relatively main scanning and sub-scanning the plurality of print heads with respect to the printing medium, wherein (a) the plurality of print heads form a plurality of test pattern images on the printing medium in one main scanning by the main scanning mechanism;

(b) the scanner reads the plurality of test pattern images by sub-scanning by the sub-scanning mechanism, without moving in the main scanning direction; and (c) on the basis of results of detection from the scanner, the control section calculates an amount of positional offset, in a sub-scanning direction, at the two print heads which form the test pattern images.

2. An image forming apparatus according to claim 1, wherein the plurality of print heads and the scanner are fixed on a carriage which is movable in the main scanning direction by the main scanning mechanism.

3. An image forming apparatus according to claim 2, wherein the plurality of test patterns have horizontal lines at the end portions at sides near each other.

4. An image forming apparatus according to claim 3, wherein the plurality of test patterns have the plurality of horizontal lines.

5. An image forming apparatus according to claim 3, wherein the plurality of test patterns each have the same number of a plurality of horizontal lines.

6. An image forming apparatus according to claim 5, wherein intervals, in the sub-scanning direction, between the plurality of horizontal lines of each test pattern are constant.

7. An image forming apparatus according to claim 5, wherein the plurality of test patterns are printed so as to not overlap each other.

8. An image forming apparatus according to claim 7, wherein the plurality of test patterns are printed at different positions in the main scanning direction.

9. An image forming apparatus according to claim 8, wherein the plurality of test patterns are printed such that the horizontal lines are contained within a range of a reading width of the scanner.

10. An image forming apparatus according to claim 7, wherein the plurality of test patterns are printed at the same position in the main scanning direction.

11. An image forming apparatus according to claim 2, wherein the sub-scanning mechanism comprises:

a conveying roller which conveys the printing medium in the sub-scanning direction;

a conveying motor which applies driving force to the conveying roller; and a conveying motor control section which applies a driving pulse to the conveying motor, and the control section calculates an amount of positional offset, in the sub-scanning direction, of two print heads on the basis of the results of detection of the scanner and a number of pulses of the conveying motor control section.

12. An image forming apparatus according to claim 11, wherein, while the scanner reads the plurality of test patterns, the conveying motor control section applies predetermined pulses to the conveying motor and intermittently conveys the printing medium in the sub-scanning direction.

13. An image forming apparatus according to claim 12, wherein, when the scanner reads the plurality of test patterns, the conveying motor control section conveys the printing medium in the same direction as a printing medium conveying direction at a time of image printing.

14. An image forming apparatus according to claim 11, wherein, while the scanner reads the plurality of test patterns, the main scanning mechanism stops movement of the carriage.

15. An image forming apparatus according to claim 1, wherein the plurality of test patterns are printed by two print heads adjacently fixed on a carriage.

16. An image forming apparatus according to claim 1, wherein the scanner has a sensor to which three color filters of R, G, B are applied.

17. An image forming apparatus according to claim 16, wherein, when two test pattern images having different colors are read among the plurality of test patterns, the scanner uses a sensor to which a color filter, which is such that a sensitivity of the test pattern image having a lowest sensitivity is made to be a highest sensitivity, is applied.

* * * * *